US010720718B2

(12) United States Patent
Kimura et al.

(10) Patent No.: US 10,720,718 B2
(45) Date of Patent: Jul. 21, 2020

(54) BRANCH CONNECTOR AND COMMUNICATION NETWORK

(71) Applicant: Yazaki Corporation, Tokyo (JP)

(72) Inventors: Syuji Kimura, Shizuoka (JP); Gaku Itou, Shizuoka (JP); Masanori Akashi, Shizuoka (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 0 days.

(21) Appl. No.: 16/168,254

(22) Filed: Oct. 23, 2018

(65) Prior Publication Data

US 2019/0123459 A1 Apr. 25, 2019

(30) Foreign Application Priority Data

Oct. 25, 2017 (JP) ..... 2017-206247
Mar. 29, 2018 (JP) ..... 2018-063784

(51) Int. Cl.
*H01R 4/2429* (2018.01)
*H01R 13/6591* (2011.01)
*H01R 4/70* (2006.01)
*H01R 13/6463* (2011.01)

(52) U.S. Cl.
CPC ..... *H01R 4/2429* (2013.01); *H01R 4/70* (2013.01); *H01R 13/6591* (2013.01); *H01R 13/6463* (2013.01)

(58) Field of Classification Search
CPC .. H01R 4/2429; H01R 4/2416; H01R 4/2454; H01R 4/2462; H01R 4/2466
USPC ..... 439/395
See application file for complete search history.

(56) References Cited

U.S. PATENT DOCUMENTS 4,778,405 A * 10/1988 Sterken ..... H01R 4/2429 439/395
5,556,297 A * 9/1996 Bray ..... H01R 4/2404 439/405
5,934,930 A * 8/1999 Camps ..... H01R 4/2404 439/425
5,942,964 A * 8/1999 Takeuchi ..... H05K 9/0066 174/92
6,285,265 B1 * 9/2001 Morita ..... H01F 17/06 333/12
6,512,425 B2 * 1/2003 Morita ..... H01F 17/06 324/127
6,633,000 B2 * 10/2003 Kuo ..... H05K 9/0066 174/92
6,716,055 B1 * 4/2004 Echito ..... H01R 4/2404 439/417

(Continued)

FOREIGN PATENT DOCUMENTS

JP 2016-115505 A 6/2016
JP 2016-152147 A 8/2016

*Primary Examiner* — Peter G Leigh
(74) *Attorney, Agent, or Firm* — Sughrue Mion, PLLC

(57) ABSTRACT

A branch connector includes: a first housing having a wiring route portion in which two first cables constituting a twisted pair cable are wired in a twisted shape to be spaced apart from each other; and a second housing to which a pair of pressure contact terminals connected respectively with two second cables constituting a twisted pair cable is fixed. The pair of pressure contact terminals is connected respectively with the two first cables by pressure contact in a state where the second housing is assembled with the first housing.

16 Claims, 17 Drawing Sheets

(56) References Cited

U.S. PATENT DOCUMENTS

| | | | | |
|---|---|---|---|---|
| 6,769,931 | B2 * | 8/2004 | Negishi | H01R 4/2433 439/402 |
| 6,827,600 | B2 * | 12/2004 | Negishi | H01R 4/2433 439/404 |
| 7,273,389 | B2 * | 9/2007 | Hoppach | H01R 4/2404 439/275 |
| 7,319,376 | B2 * | 1/2008 | Kobayashi | H01F 17/06 336/175 |
| 7,341,474 | B2 * | 3/2008 | Clem | G01R 15/04 439/424 |
| 7,550,670 | B2 * | 6/2009 | Kuo | H01R 13/719 174/74 R |
| 7,859,378 | B2 * | 12/2010 | Merck | G01R 1/22 336/174 |
| 7,892,021 | B2 * | 2/2011 | Clem | H01R 12/675 439/386 |
| 8,182,281 | B2 * | 5/2012 | Miller | H01R 4/2416 439/397 |
| 8,188,395 | B2 * | 5/2012 | Steidle | H01H 5/20 200/302.1 |
| 9,379,492 | B2 * | 6/2016 | Zebhauser | H01R 13/6585 |
| 2003/0184204 | A1 * | 10/2003 | McCoy | H01R 4/4818 313/318.12 |
| 2010/0093206 | A1 * | 4/2010 | Chuen | H01R 4/2408 439/391 |
| 2016/0164574 | A1 * | 6/2016 | Ackermann | H04B 3/548 307/104 |
| 2017/0264064 | A1 | 9/2017 | Matsui et al. | |
| 2018/0034168 | A1 * | 2/2018 | Matsui | H01R 4/2429 |

* cited by examiner

BRANCH CONNECTOR AND COMMUNICATION NETWORK

CROSS REFERENCE TO RELATED APPLICATION

The present application is based on, and claims priority from Japanese Patent Applications No. 2017-206247, filed Oct. 25, 2017, and No. 2018-063784, filed Mar. 29, 2018, the entire contents of all of which are incorporated herein by reference.

TECHNICAL FIELD

The present application relates to a branch connector to be used for branching a twisted pair cable, and a communication network using the branch connector.

BACKGROUND ART

Disclosure in JP 2016-152147 A has been proposed as a conventional branch connector to be used for branching a twisted pair cable. As illustrated in FIGS. 17 and 18, a conventional branch connector 100 includes a housing 102 having a pair of right and left terminal accommodating chambers 101, and a pair of pressure contact terminals 110 arranged in the respective terminal accommodating chambers 101. The pair of terminal accommodating chambers 101 is partitioned by a partition wall 103. The partition wall 103 is provided with an upper split rib 104 protruded upwardly, and a lower split rib 105 projected downwardly. A beam portion 106 is provided at an intermediate position in the vertical direction of each of the terminal accommodating chambers 101. The beam portion 106 is not arranged at the entry position of upper pressure contact blades 111 from the lower side.

Each of the pressure contact terminals 110 includes the upper pressure contact blades 111 arranged at upper positions, and lower pressure contact blades 112 arranged at lower positions. The upper pressure contact blades 111 and the lower pressure contact blades 112 are coupled with each other.

Next, the operation of assembling a pair of first cables W1 constituting a twisted pair cable, a pair of second cables W2 constituting a twisted pair cable, and the pressure contact terminals 110 with the housing 102 will be described.

First, the two second cables W2 partially unwound from the twist of the twisted pair cable are split by the lower split rib 105 and inserted into the pair of terminal accommodating chambers 101 from below the housing 102.

Next, the respective pressure contact terminals 110 are inserted into the respective terminal accommodating chambers 101 from below the housing 102. In insertion of the pressure contact terminals 110 from below the housing 102, the second cables W2 are prevented from moving upward by the beam portions 106. Therefore, the upper pressure contact blades 111 of the pressure contact terminals 110 pass while cutting the insulating sheath of the second cables W2. Then, further insertion of the pressure contact terminals 110 from below the housing 102 is continued, so that the respective second cables W2 are connected with corresponding lower pressure contact blades 112 by pressure contact.

Next, the two first cables W1 partially unwound from the twist of the twisted pair cable are split by the upper split rib 104 and inserted into the pair of terminal accommodating chambers 101 from above the housing 102. When the respective first cables W1 are inserted into the respective terminal accommodating chambers 101 of the housing 102, the respective first cables W1 are connected with corresponding upper pressure contact blades 111 by pressure contact.

As a result, the two first cables W1 constituting a twisted pair cable and corresponding two second cables W2 constituting a twisted pair cable are electrically connected with each other via the pair of pressure contact terminals 110.

SUMMARY

However, the conventional branch connector 100 has a problem that communication quality deteriorates, since the twisted shape of the two first cables W1 constituting a twisted pair cable and the twisted shape of the two second cables W2 constituting a twisted pair cable are both unwound in a section.

The present application has been made with the aim of solving the above mentioned problems, and it is an object of the present application to provide a branch connector capable of branching a twisted pair cable while maintaining communication quality, and a communication network using the branch connector.

A branch connector according to an aspect of the present application includes: a first housing having a wiring route portion in which two first cables constituting a twisted pair cable are wired in a twisted shape to be spaced apart from each other; and a second housing to which a pair of pressure contact terminals connected respectively with two second cables constituting a twisted pair cable are fixed, the pair of pressure contact terminals being connected respectively with the two first cables by pressure contact in a state where the second housing is assembled with the first housing.

With the branch connector according to the aspect of the present application, it is possible to branch a twisted pair cable while maintaining communication quality, since wiring is achieved with the twisted shape being maintained though the distance between the two first cables is increased.

DESCRIPTION OF EMBODIMENTS

The following description will explain some embodiments with reference to the drawings.

First Embodiment

FIGS. 1 to 10 illustrate a first embodiment.

Figure 10:
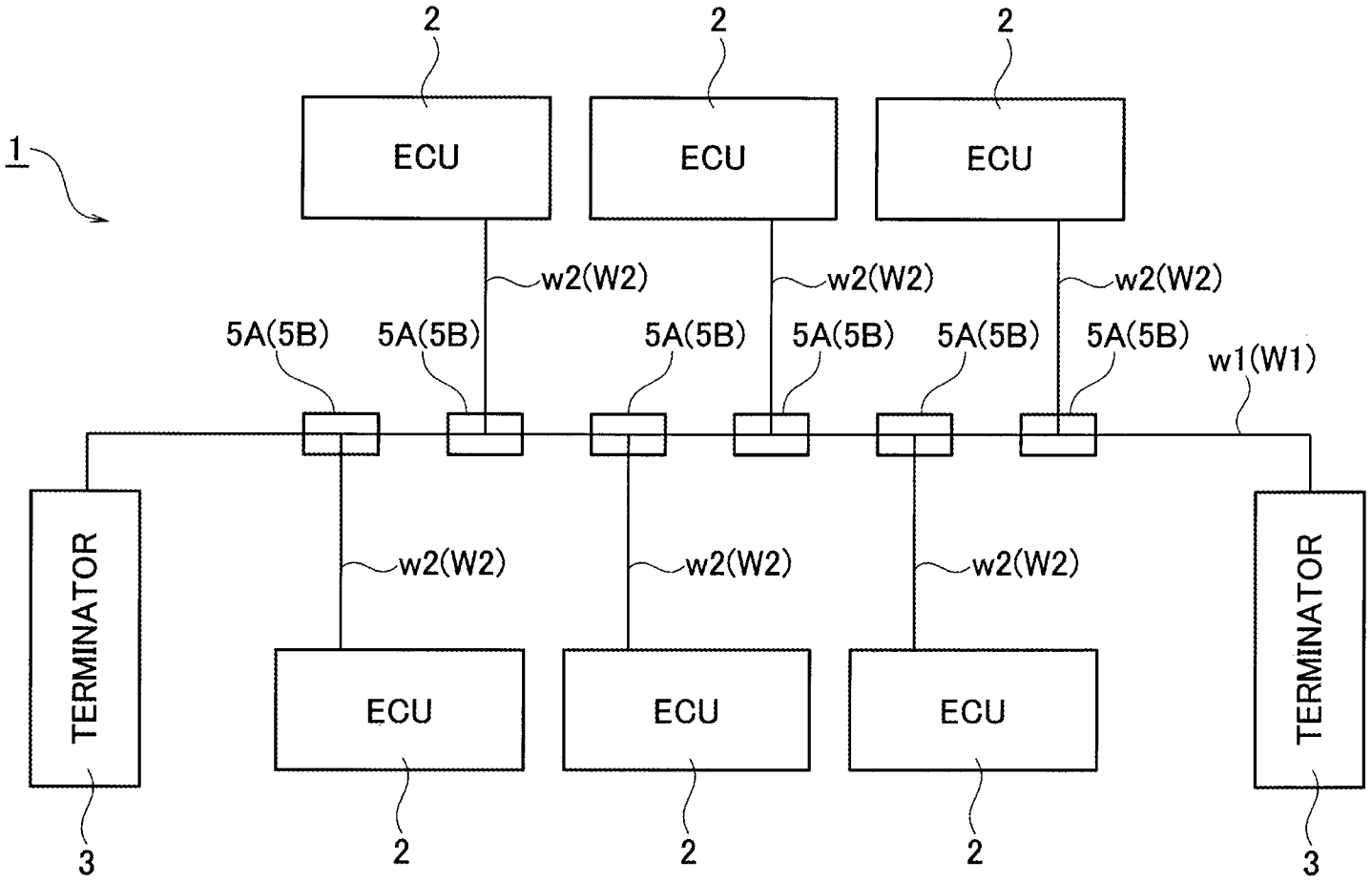
FIG. 10 is a block diagram of a communication network using the branch connector according to the first embodiment and a branch connector according to a second embodiment.
Figure 11:
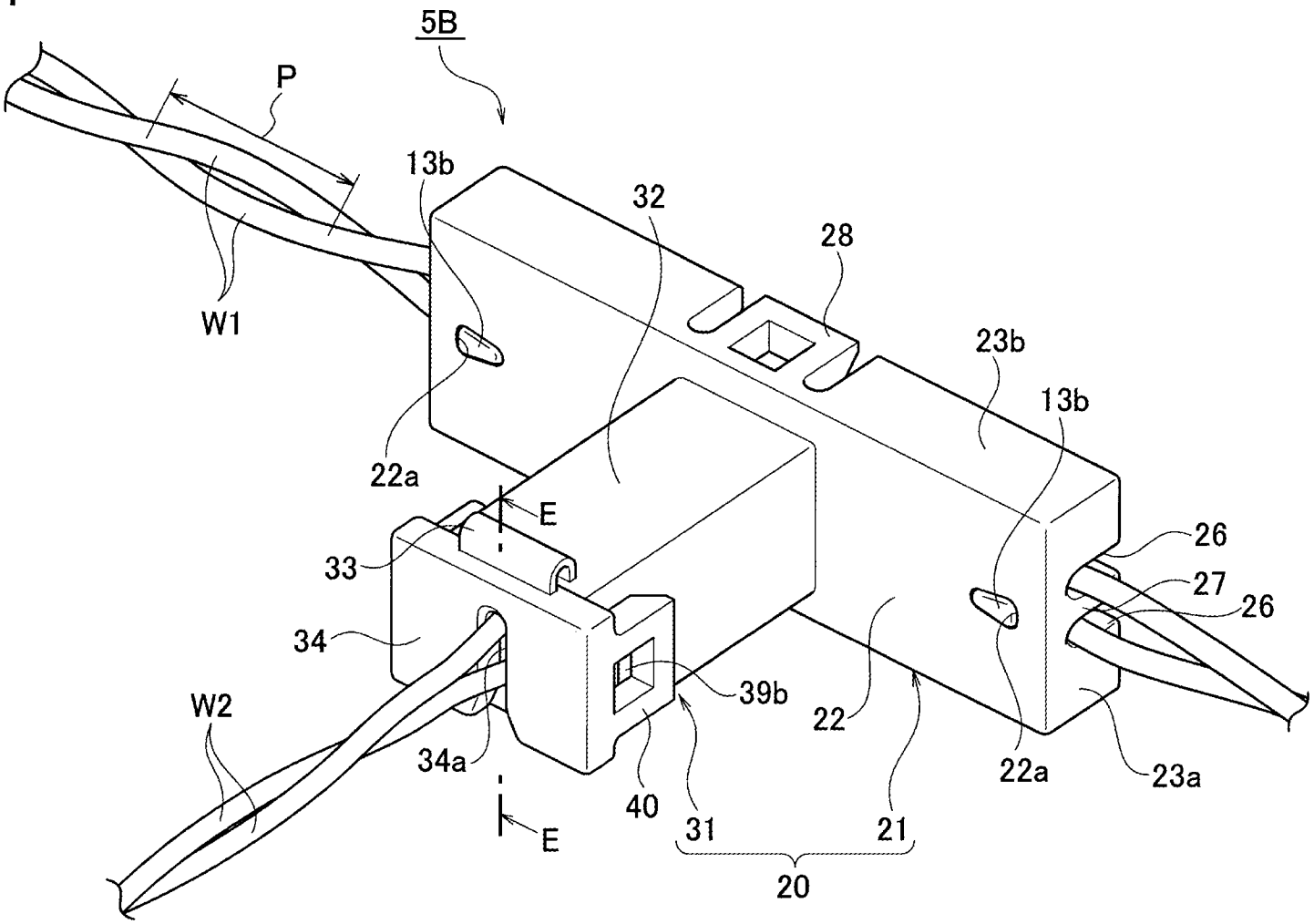
FIG. 11 is a general perspective view of the branch connector according to the second embodiment.
Figure 12:
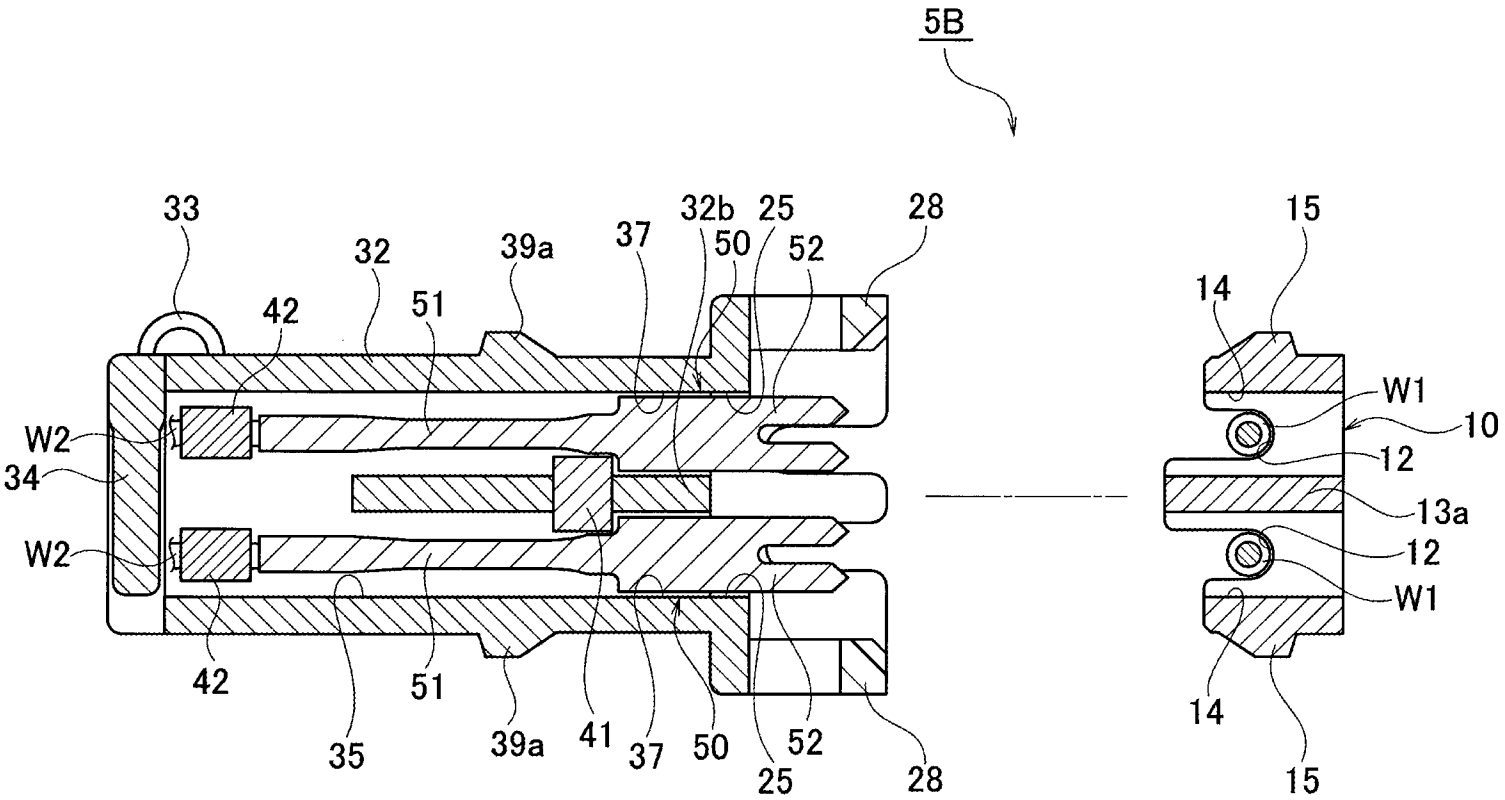
FIG. 12 is a sectional view illustrating a state before a first housing is fitted to a second housing in the branch connector according to the second embodiment along line E-E of FIG. 11.
Figure 13:
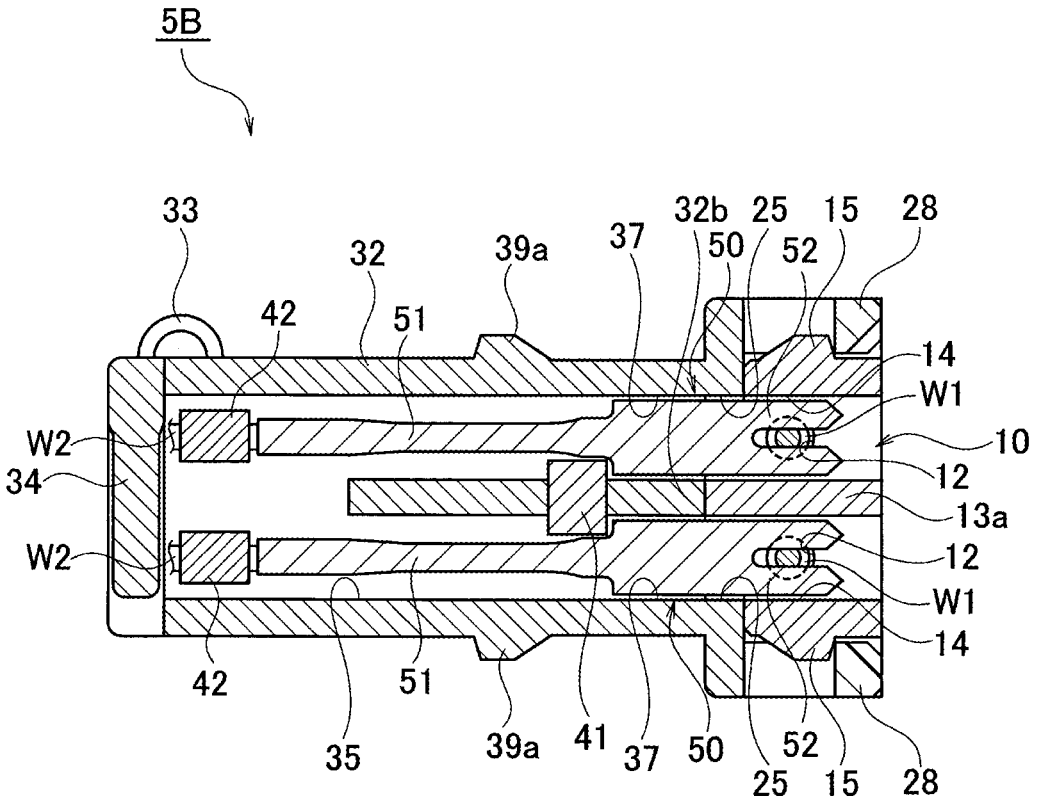
FIG. 13 is a sectional view illustrating a state where the first housing is fitted to the second housing in the branch connector according to the second embodiment along line E-E of FIG. 11.

In the first embodiment, a communication network 1 as illustrated in FIG. 10 is mounted on a vehicle. The communication network 1 includes: a trunk line w1; a plurality of branch lines w2 branched at a plurality of points of the trunk line w1; a plurality of electronic control units (ECUs) 2 connected with the respective branch lines w2; and two terminators 3 connected with both ends of the trunk line w1. Each of the ECUs 2 is equipped with a CAN interface (not illustrated). Each of the ECUs 2 transmits and receives signals by controller area network (CAN) communication.

For the trunk line w1, two first cables W1 constituting a twisted pair cable are used. The two first cables W1 are wired in a twisted shape substantially in close contact. For each of the branch lines w2, two second cables W2 which also constitute a twisted pair cable are used. The two second cables W2 are wired in a twisted shape substantially in close contact. In addition, branching from the twisted pair cable of the trunk line w1 is achieved by a branch connector 5A according to the first embodiment.

As illustrated in FIGS. 1 to 5, the branch connector 5A according to the first embodiment includes: a first housing 10 in which two first cables W1 constituting a twisted pair cable on the side of the trunk line w1 pass and are wired; and a second housing 20 to which a pair of pressure contact terminals 50 connected with two second cables W2 constituting a twisted pair cable on the side of each of the branch lines w2 is fixed.

The first housing 10 has a substantially rectangular plate shape. The first housing 10 is provided with a wiring route portion 11. The wiring route portion 11 is provided with twist grooves 12, and three ribs 13*a*, 13*b* erected at intervals in the wiring direction of the two first cables W1. The twist grooves 12 are formed as grooves having shapes following the twisted shape of the two first cables W1 spaced apart from each other. The three ribs 13*a*, 13*b* are arranged at an interval substantially equal to the interval of the twist pitch P between the two first cables W1. The central rib 13*a* is substantially rhombic when viewed from above. The central positions where both side faces of the central rib 13*a* are most separated from each other become the pressure contact positions of the pair of pressure contact terminals 50. The ribs 13*b* on the respective both end sides are substantially isosceles triangular when viewed from above.

The three ribs 13*a*, 13*b* of the wiring route portion 11 respectively wedge into a space between the two first cables W1, so that the distance between the two first cables W1 is increased while maintaining the twisted shape, and the two first cables W1 are wired in the twist grooves 12 in a twisted shape. The two first cables W1 wired in the twist grooves 12 are drawn out of the first housing 10 from both ends of the twist grooves 12. The twist pitch of the two first cables W1 in the wiring route portion 11 is substantially equal to the twist pitch P of the two first cables W1 other than in the wiring route portion 11.

The wiring route portion 11 is provided with a pair of pressure contact blade guide grooves 14 continuous from the top face of the central rib 13*a* to the bottom face of each of the twist grooves 12. Each of the pressure contact blade guide grooves 14 is formed to have a thickness dimension substantially equal to the thickness of a pressure contact blade 52, or a slightly larger width dimension.

A pair of first locking claws 15 is projected from both side faces of the first housing 10.

The second housing 20 includes a uniting housing 21 to be assembled with the first housing 10, and a terminal fixing housing 31, which is separate from the uniting housing 21 and to which the pair of pressure contact terminals 50 is fixed.

Figure 5A:
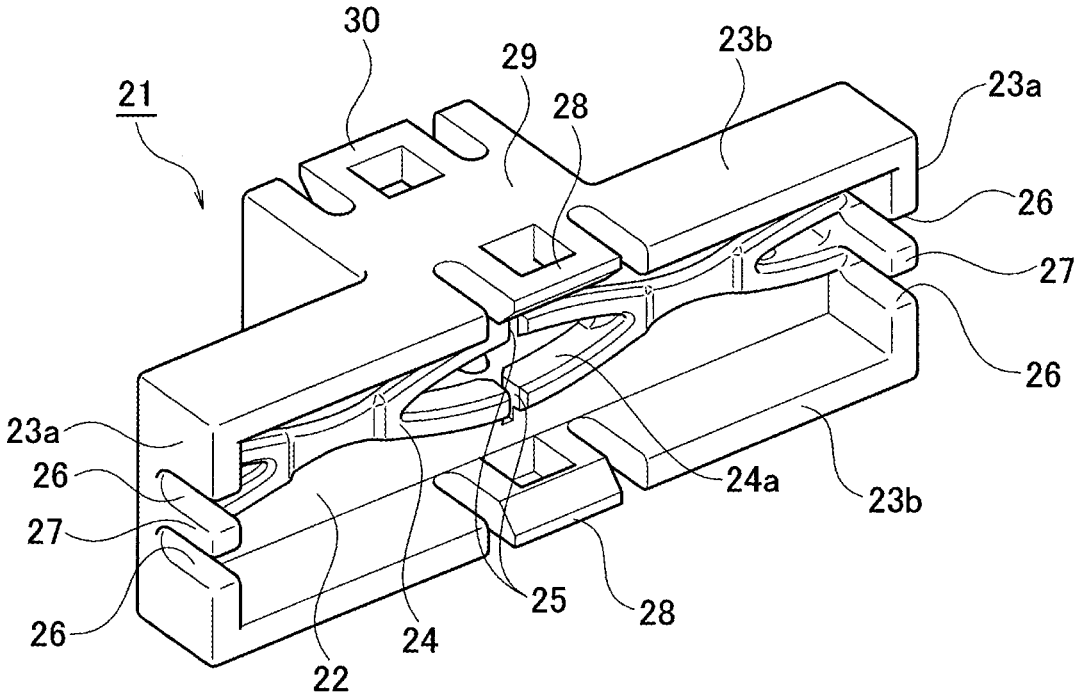
FIG. 5A is a perspective view of an inner face side of a uniting housing portion of a second housing of the branch connector according to the first embodiment.
Figure 5B:
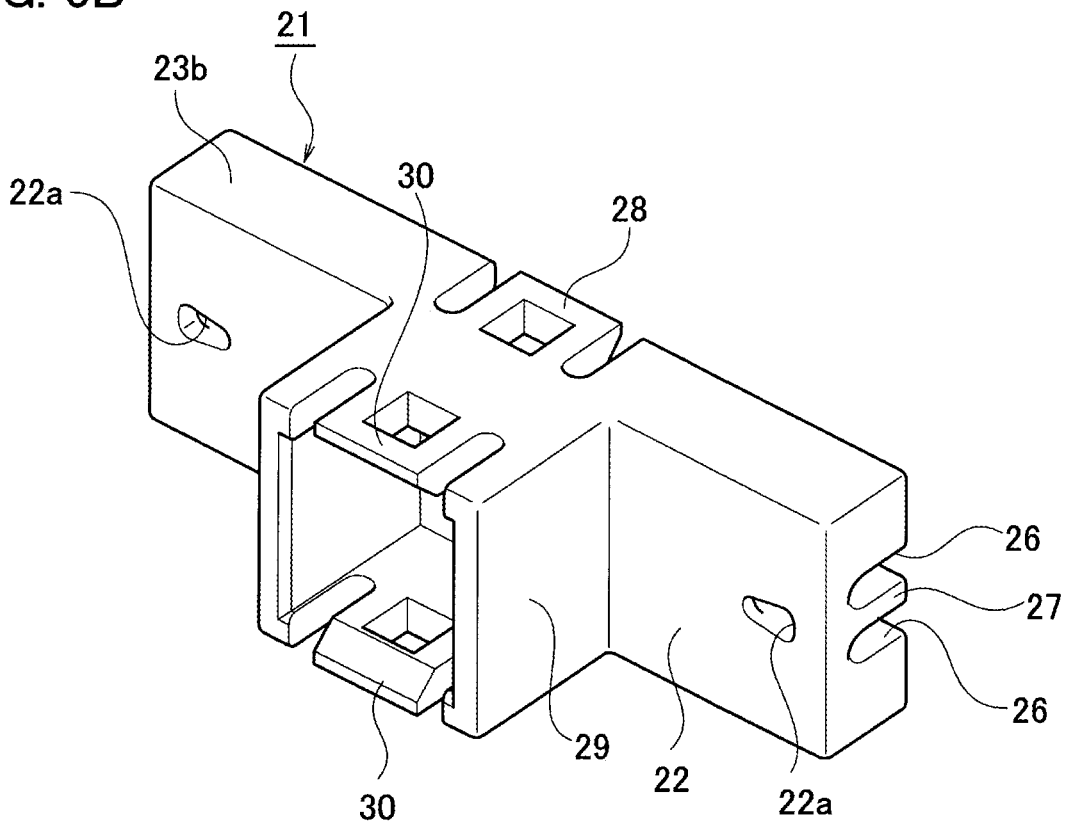
FIG. 5B is a perspective view of an outer face side of the uniting housing portion of the second housing of the branch connector according to the first embodiment.

The uniting housing 21 has an upper face wall 22 formed to have a dimension slightly larger than the first housing 10, and four side walls 23*a*, 23*b* vertically provided from the entire circumference edge of the upper face wall 22. As illustrated in FIG. 5A, a projecting wall 24 having a shape following the shapes of the twist grooves 12 (a shape following a twisted shape with an increased distance between the two first cables W1) is provided on an inner face of the upper face wall 22. The projecting wall 24 enters into the twist grooves 12 in a state of being assembled with the first housing 10. A positioning recess 24*a* is provided inside the upper face wall 22 by being surrounded by the projecting wall 24. As illustrated in FIG. 5B, a pair of positioning holes 22*a* is formed at both end portions of the upper face wall 22. A pair of pressure contact blade approach holes 25 (see FIGS. 3A and 5A, and the like) is formed at the upper face wall 22.

The four side walls 23*a*, 23*b* of the uniting housing 21 are arranged at positions to cover the entire side face of the first housing 10 in a state of being assembled with the first housing 10. A pair of cable insertion grooves 26 is formed respectively in the pair of first side walls 23*a* orthogonal to the wiring direction of the first cables W1. A rib 27 is provided between the pair of cable insertion grooves 26 of each of the side wall 23*a*. The rib 27 wedges into a space between the two first cables W1 together with the ribs 13*b* on both end sides of the first housing 10 in a state of being assembled with the first housing 10.

A pair of elastic locking frames 28 is provided at the pair of second side walls 23*b* extending along the same direction as the wiring direction of the first cables W1. The pair of elastic locking frames 28 is locked to the pair of first locking claws 15 of the first housing 10, so that the uniting housing 21 of the second housing 20 is assembled with the first housing 10.

The uniting housing 21 includes a connector fitting portion 29 on the upper face of the upper face wall 22. The pair of pressure contact blade approach holes 25 is opened in a portion inside the connector fitting portion 29 of the upper face wall 22. A pair of elastic locking frames 30 is provided on the side of the fitting entrance of the connector fitting portion 29. The terminal fixing housing 31 is fitted to the connector fitting portion 29.

The terminal fixing housing 31 includes a connector housing 32, and a closing cover 34 coupled with the connector housing 32 via a hinge 33. A terminal accommodating chamber 35 is provided inside the connector housing 32. A rear wall 32*a* of the connector housing 32 is provided with a terminal insertion port 36. A front wall 32*b* of the connector housing 32 is provided with a pressure contact blade protrusion port 37. The connector housing 32 is provided with a lance fitting port 38 to which a locking lance 41 is fitted. On the front portion side of the connector housing 32, a pair of second locking claws 39*a* is provided. On the rear portion side of the connector housing 32, a pair of third locking claws 39*b* is provided.

A cable draw-out groove 34*a* is formed at the closing cover 34. A pair of elastic locking frames 40 is projected from the closing cover 34. By locking the pair of elastic locking frames 40 of the closing cover 34 to the pair of third locking claws 39*b* of the connector housing 32, the terminal insertion port 36 is closed by the closing cover 34.

Each of the pressure contact terminals 50 includes a crimp portion 51 to be crimped and connected with the corresponding second cable W2, and a pressure contact blade 52 to be connected with the corresponding first cable W1 by pressure contact. The crimp portion 51 of each of the pressure contact terminals 50 is crimped and connected with an end portion of the corresponding second cable W2 unwound from the twisted shape. A cylindrical ferrite component 42 is mounted on the outer circumference of an end portion of each of the second cables W2 unwound from the twisted shape.

The pair of pressure contact terminals 50 is arranged in the terminal accommodating chamber 35 of the connector housing 32 in a state where the pressure contact terminals 50 are positioned by the locking lance 41 and the like. The pressure contact blades 52 of the respective pressure contact terminals 50 protrude from the pressure contact blade protrusion port 37. The two second cables W2 connected with the pair of pressure contact terminals 50 are drawn out of the connector housing 32 through the terminal insertion port 36 and the cable draw-out groove 34*a*.

Next, the assembling procedures of the branch connector 5A will be described.

Figure 6:
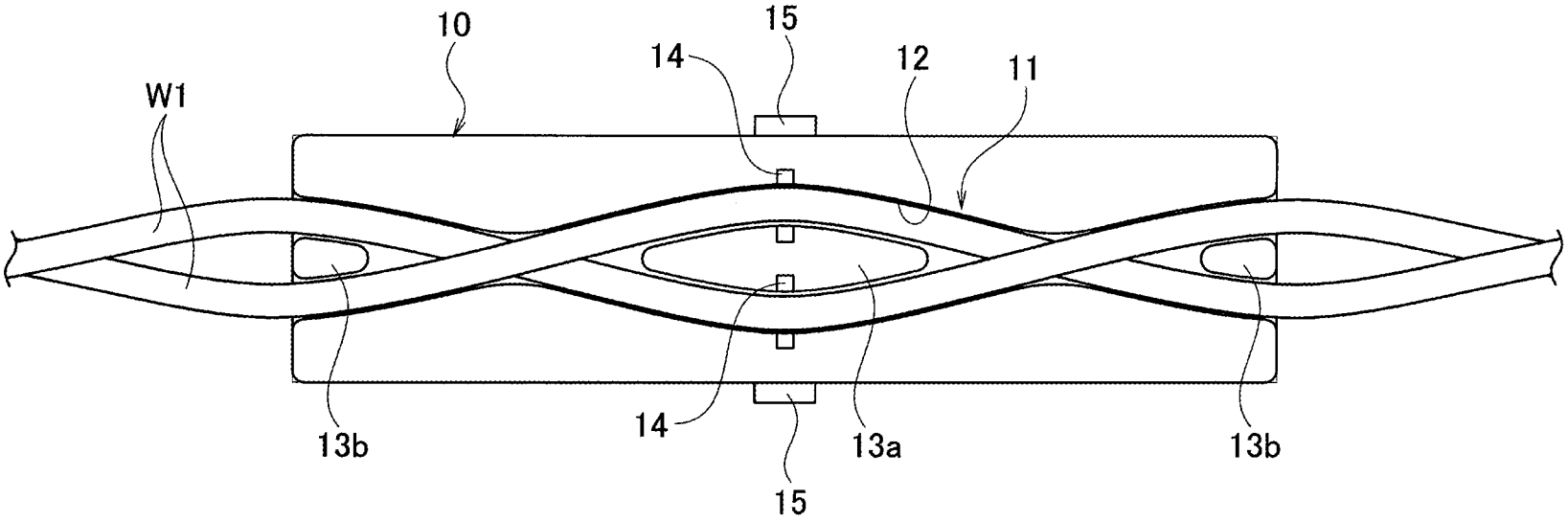
FIG. 6 is a plan view of a state where two first cables are wired in the first housing of the branch connector according to the first embodiment.

The two first cables W1 constituting the twisted pair cable are inserted into the twist grooves 12 of the first housing 10. Insertion of the two first cables W1 into the twist grooves 12 can be easily achieved by causing the ribs 13*a*, 13*b* to wedge into three places between the two first cables W1. As illustrated in FIG. 6, the two first cables W1 inserted into the twist grooves 12 are wired in a twisted shape with an increased distance between the two first cables.

Figure 7:
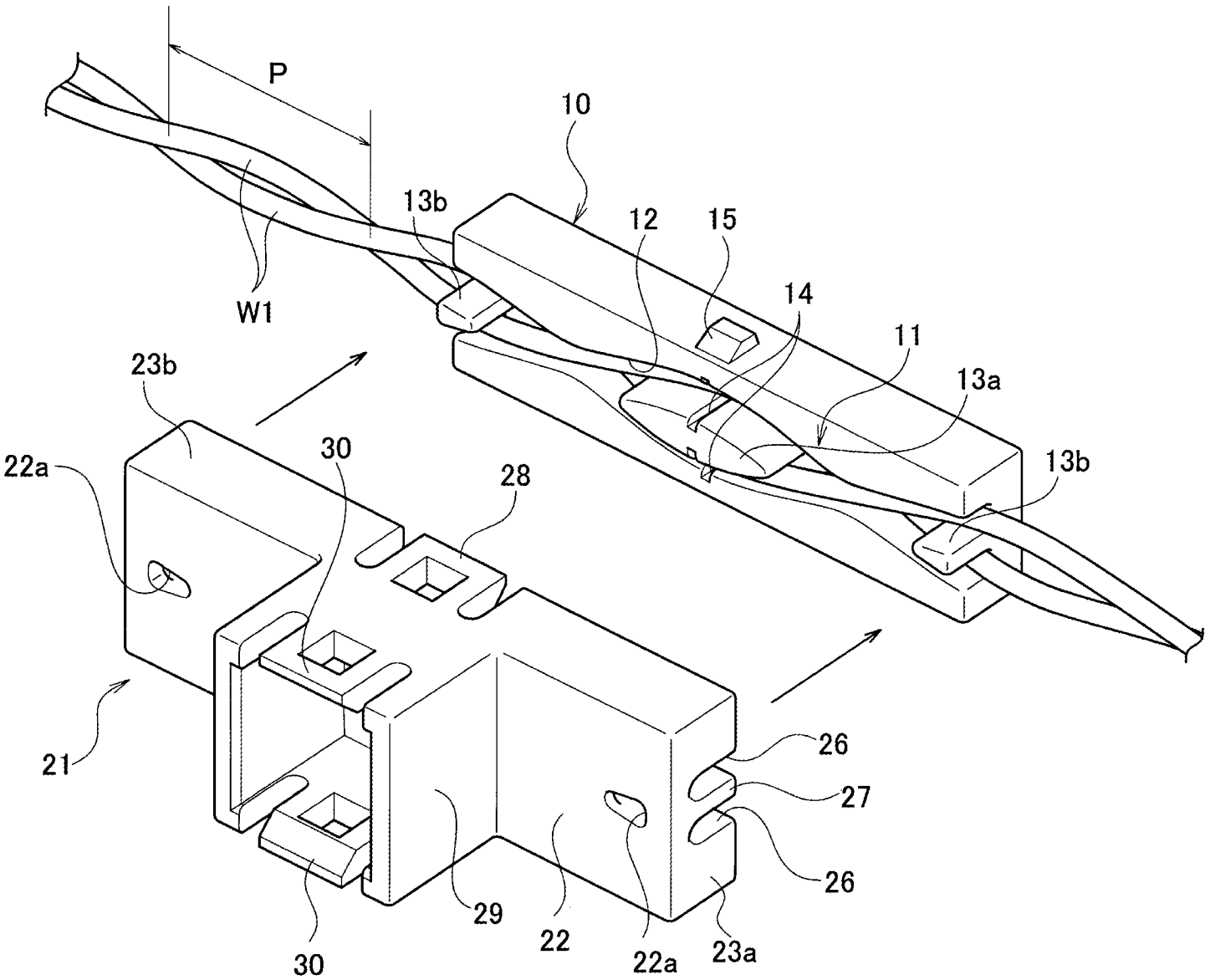
FIG. 7 is a perspective view illustrating a state before the uniting housing portion is united with the first housing in the branch connector according to the first embodiment.

Next, as illustrated in FIG. 7, the uniting housing 21 of the second housing 20 is united with the first housing 10. That is, the uniting housing 21 of the second housing 20 is placed over the first housing 10, and the elastic locking frames 30 of the uniting housing 21 are locked to the first locking claws 15 of the first housing 10. As a result, the projecting wall 24 of the uniting housing 21 enters into the twist grooves 12 of the first housing 10, and the first cables W1 are positioned in the twist grooves 12.

Moreover, the tip side of the central rib 13*a* enters into the positioning recess 24*a* of the uniting housing 21. The pair of ribs 13*b* on both end sides enters into a pair of positioning recesses 24*a* of the uniting housing 21. As a result, the first housing 10 and the uniting housing 21 (the second housing 20) are united in a positioned state.

The operation of connecting the pressure contact terminals 50 respectively with the two second cables W2 constituting the twisted pair cable, and the operation of fixing the pressure contact terminals 50 to the terminal fixing housing 31 are performed before or after the operation of uniting the first housing 10 and the uniting housing 21.

The operation of connecting the pressure contact terminals 50 with the two second cables W2 is to peel the sheath of the end portions of the two second cables W2. Before peeling or after peeling, the ferrite component 42 is mounted on the far side from the end portion of each of the second cables W2. Next, the crimp portion 51 of each of the pressure contact terminals 50 is crimped and connected with an end portion of the corresponding second cable W2. Thus, the operation of connecting the pressure contact terminals 50 with the two second cables W2 is completed.

Figure 1:
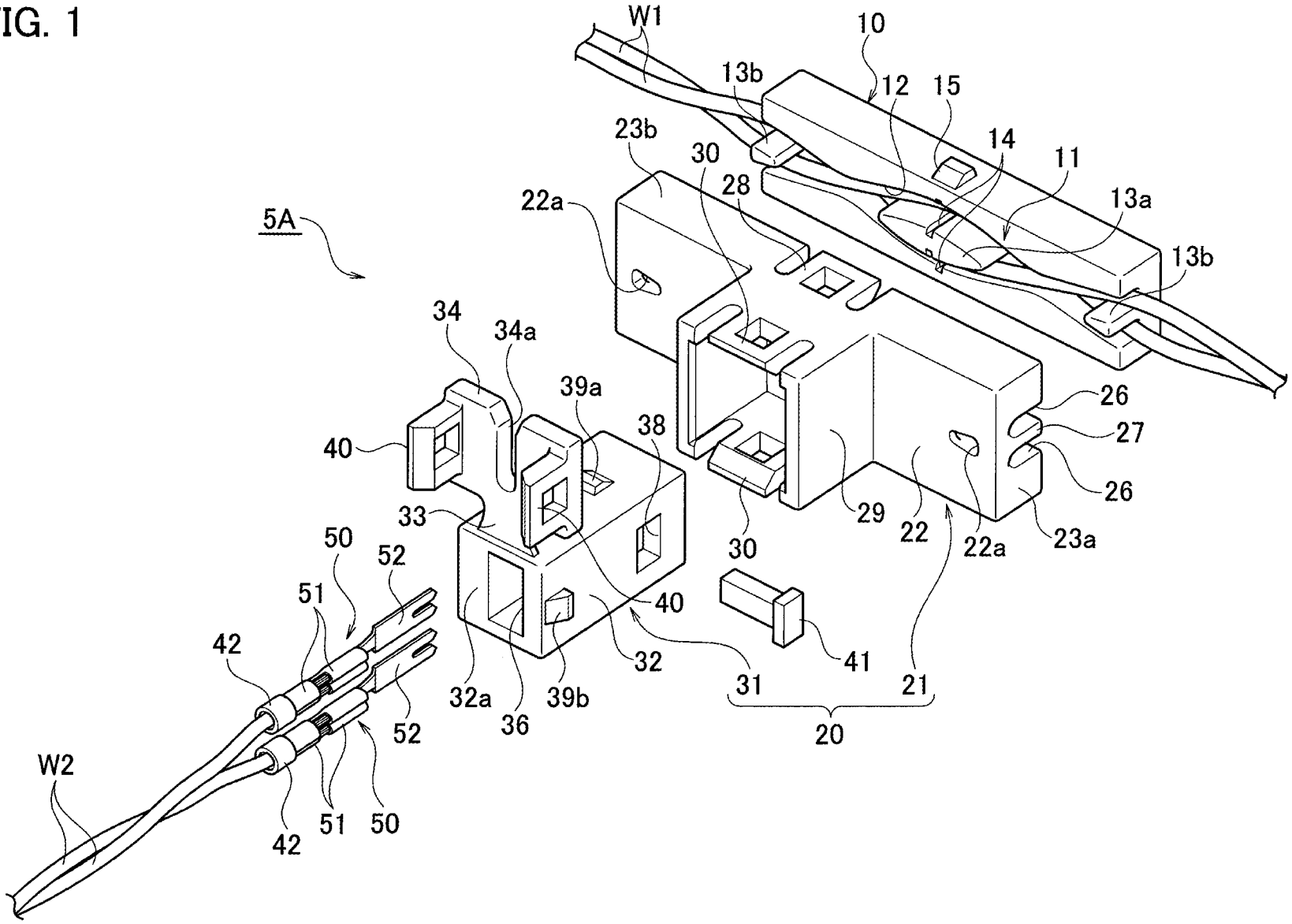
FIG. 1 is an exploded perspective view of a branch connector according to a first embodiment.
Figure 2:
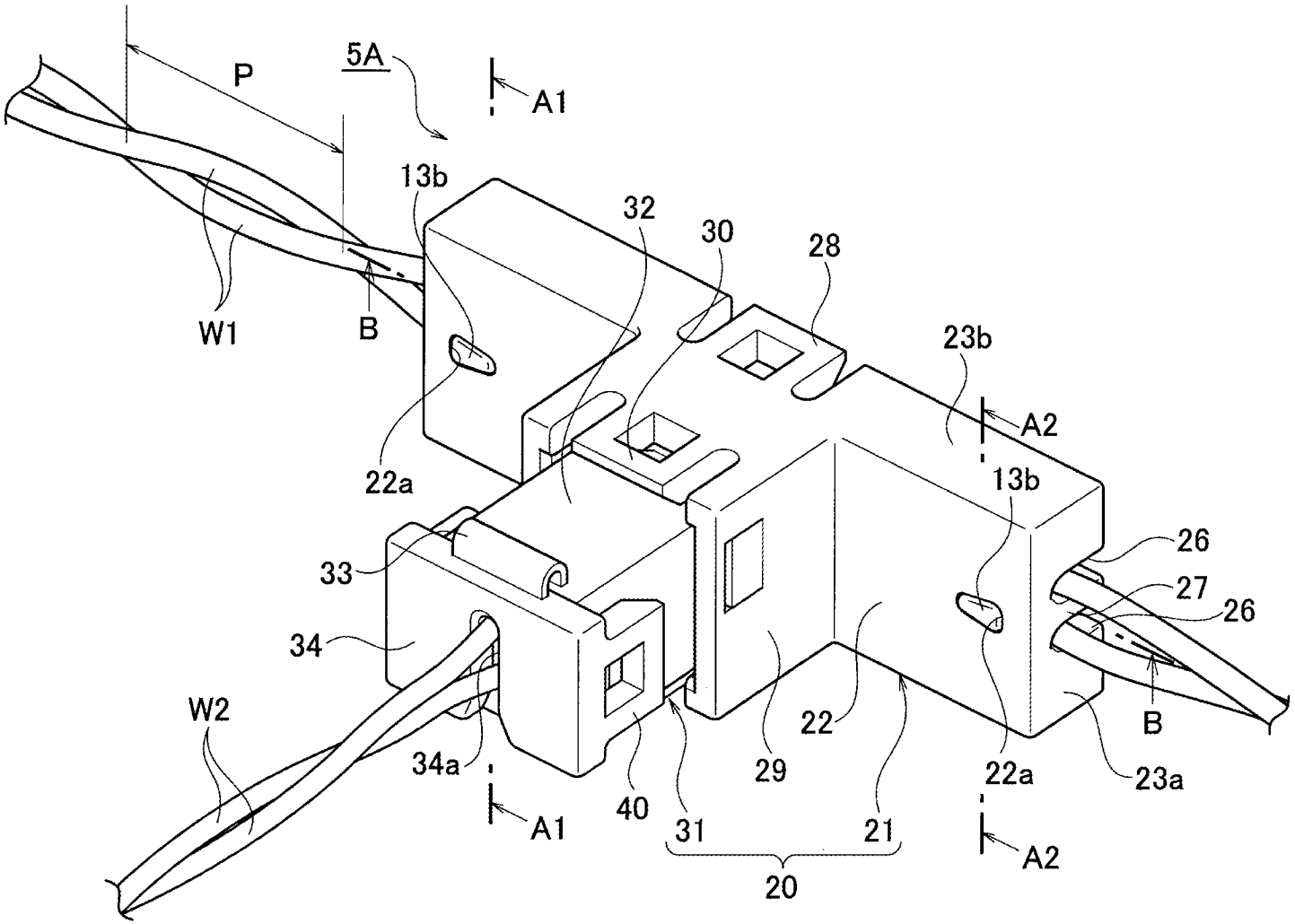
FIG. 2 is a general perspective view of the branch connector according to the first embodiment.
Figure 3A:
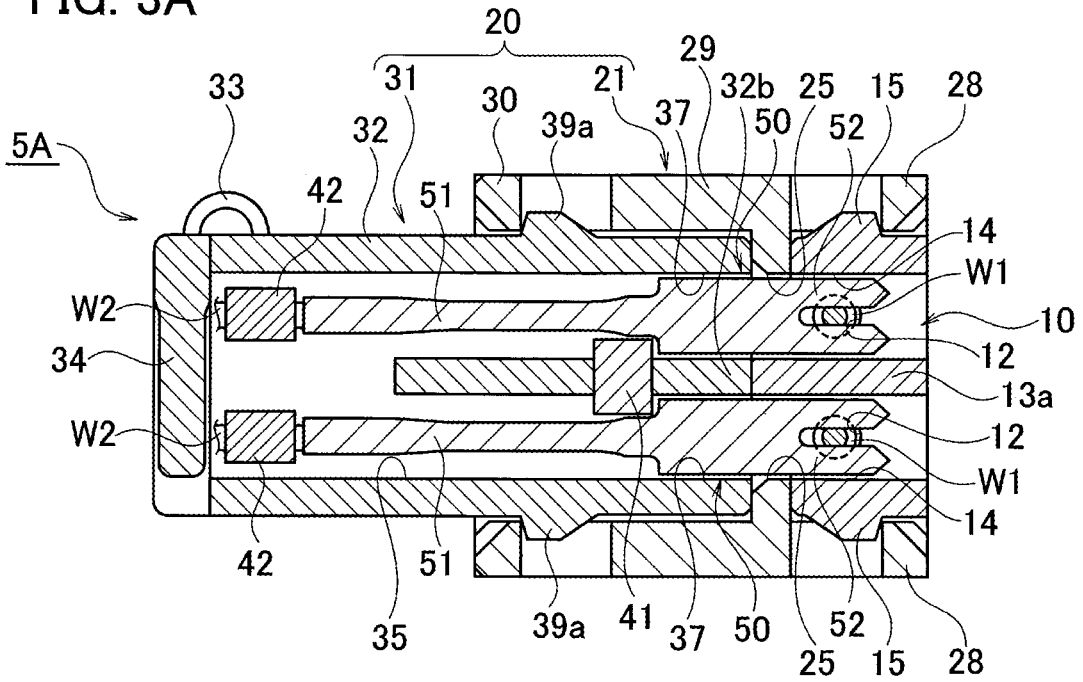
FIG. 3A is a sectional view taken along line A1-A1 of FIG. 2.
Figure 3B:
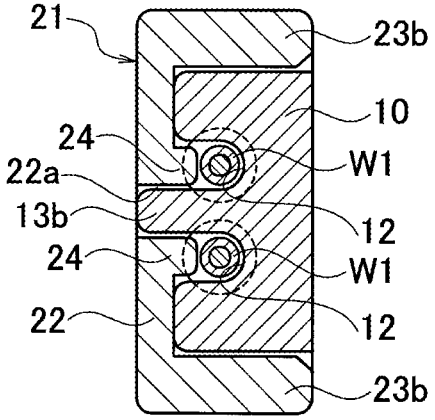
FIG. 3B is a sectional view taken along line A2-A2 of FIG. 2.
Figure 3C:
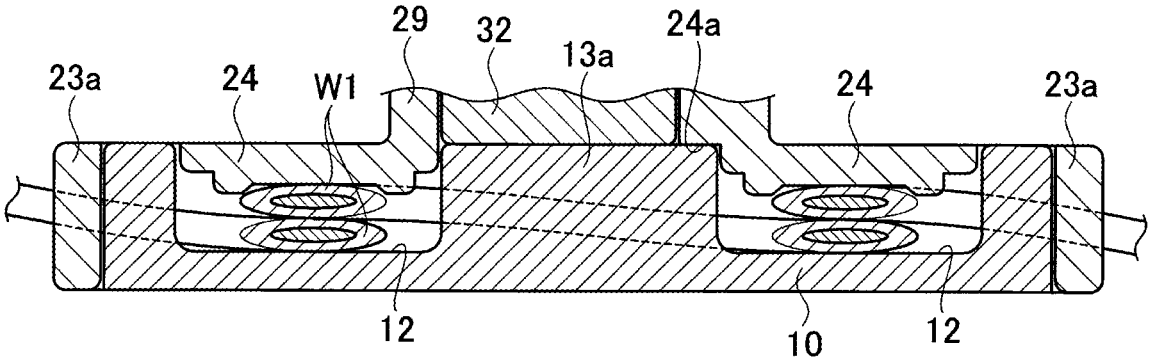
FIG. 3C is a sectional view taken along line B-B of FIG. 2.
Figure 4:
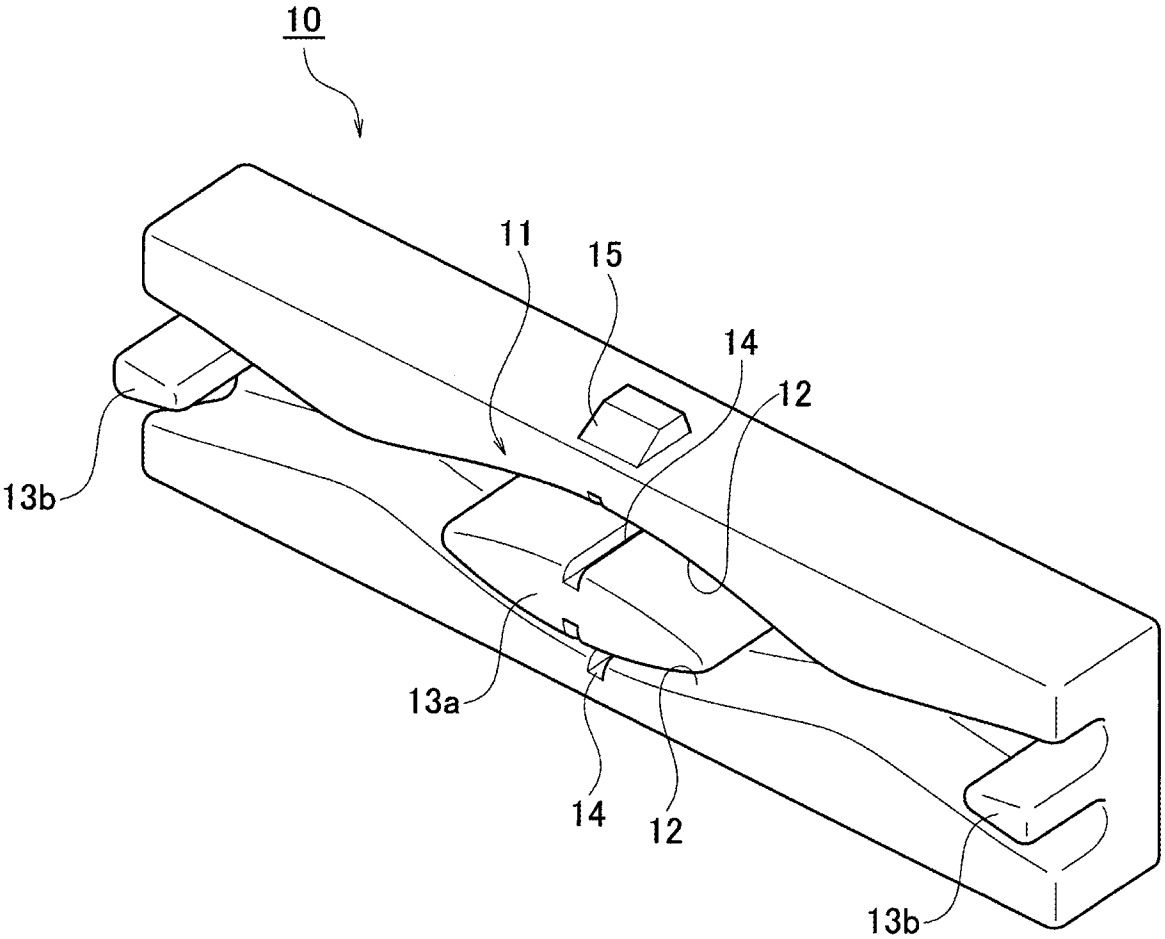
FIG. 4 is a perspective view of an inner face side of a first housing of the branch connector according to the first embodiment.

As illustrated in FIG. 1, the operation of fixing the pressure contact terminals 50 to the terminal fixing housing 31 is such that the closing cover 34 is set in an open position and the pair of pressure contact terminals 50 is inserted into the terminal accommodating chamber 35 of the connector housing 32 with the pressure contact blades 52 of the pressure contact terminals located at the tip. Next, the locking lance 41 is fitted through the lance fitting port 38. Thus, the pair of pressure contact terminals 50 is fixed to the terminal fixing housing 31. Next, as illustrated in FIG. 2, the closing cover 34 is set in a close position, and the elastic locking frame 40 of the closing cover 34 is locked to the third locking claws 39*b* of the terminal fixing housing 31. Thus, the operation of fixing the pressure contact terminals 50 to the terminal fixing housing 31 is completed.

Figure 8:
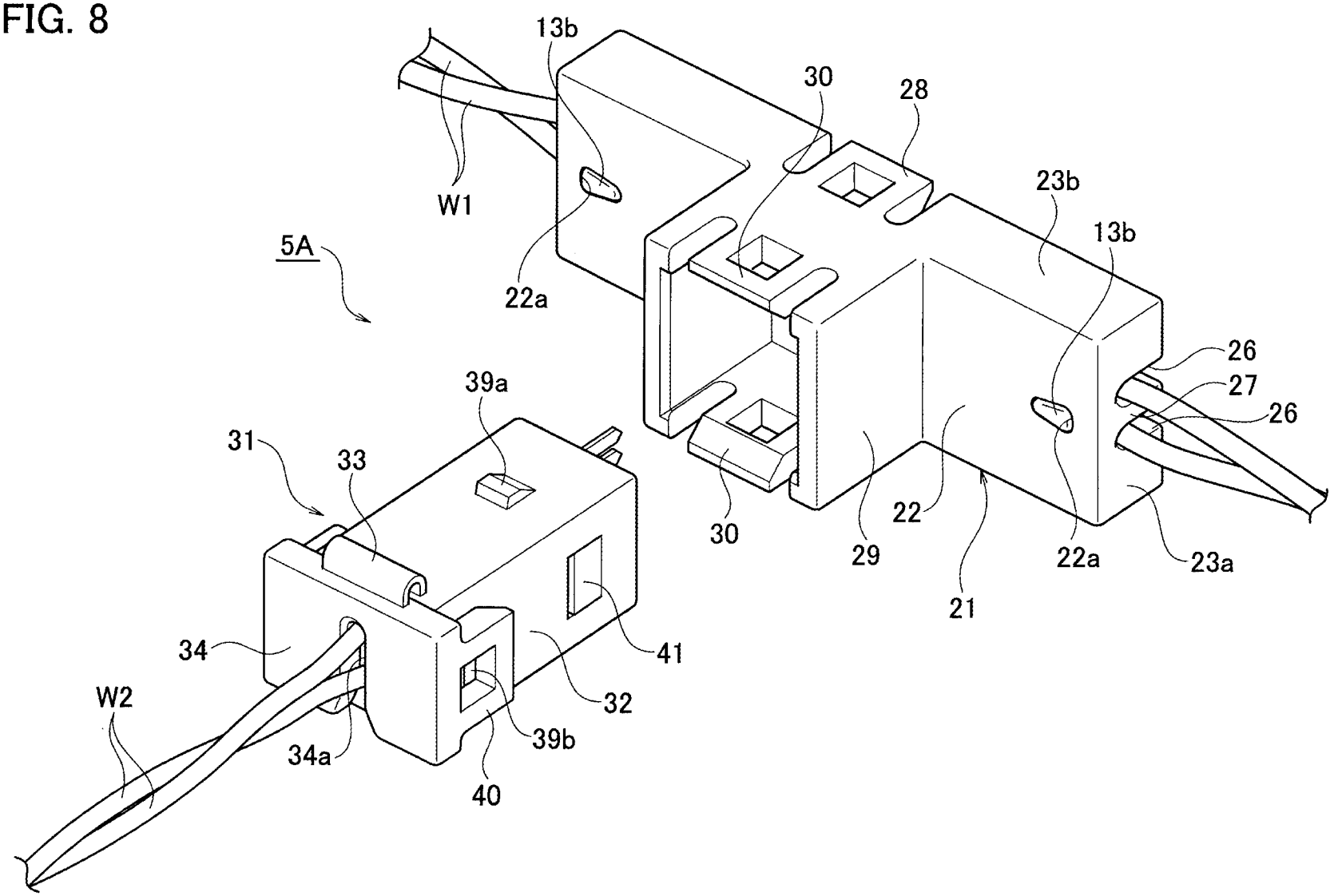
FIG. 8 is a perspective view illustrating a state before a terminal fixing housing portion is fitted to the uniting housing portion in the branch connector according to the first embodiment.
Figure 9:
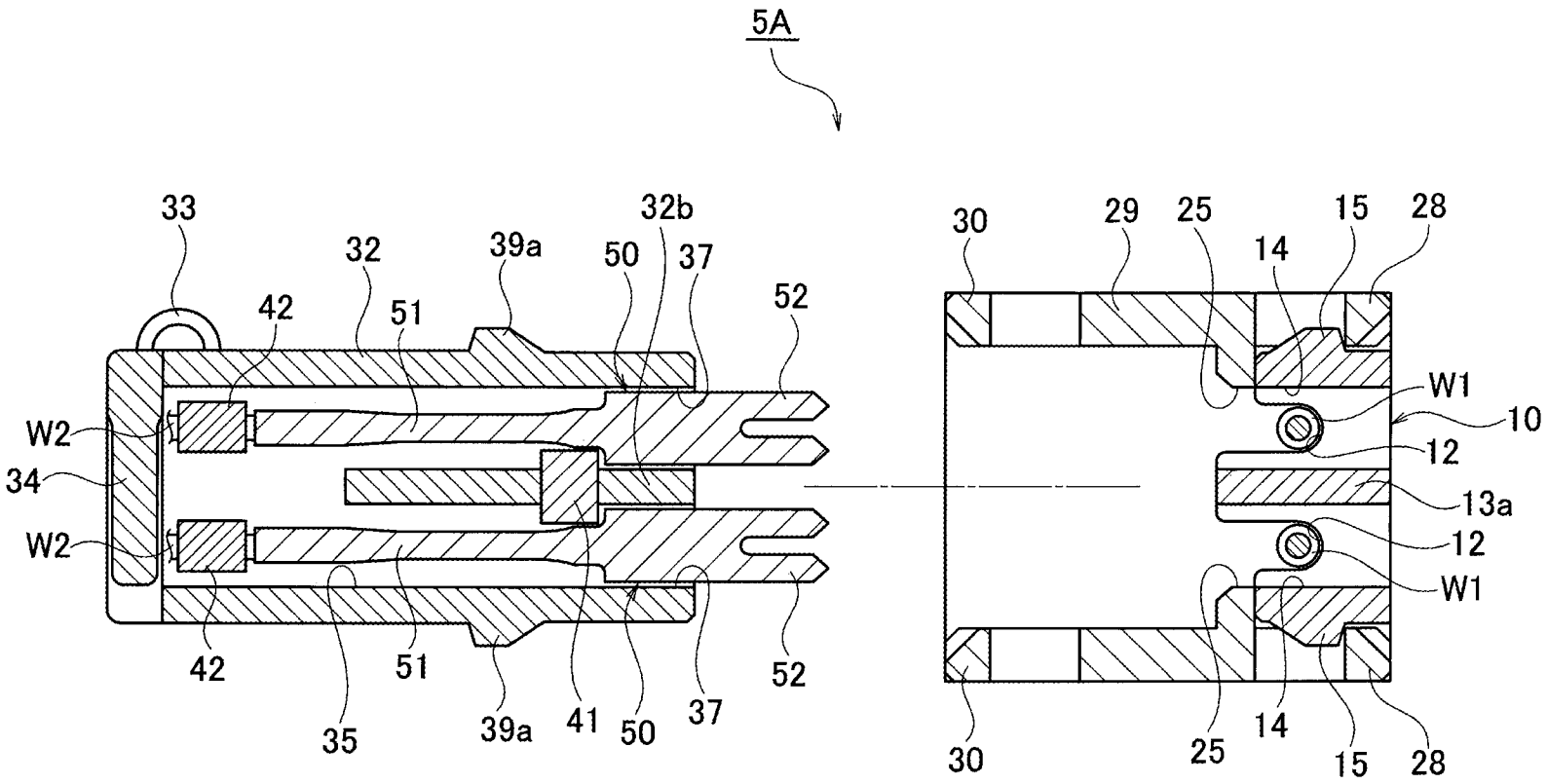
FIG. 9 is a sectional view illustrating a state before the terminal fixing housing portion is fitted to the uniting housing portion in the branch connector according to the first embodiment.

Next, as illustrated in FIGS. 8 and 9, the terminal fixing housing 31 is fitted to the connector fitting portion 29 of the uniting housing 21. That is, the terminal fixing housing 31 is inserted into the connector fitting portion 29 of the uniting housing 21, and the elastic locking frames 30 of the connector fitting portion 29 are locked to the second locking claws 39*a* of the terminal fixing housing 31. In such fitting process, the pressure contact blades 52 of the pair of pressure contact terminals 50 enter into the twist grooves 12 while being guided by the pressure contact blade guide grooves 14. In the fitting complete state, the respective pressure contact blades 52 of the pair of pressure contact terminals 50 are connected with the respective first cables W1 by pressure contact.

As described above, the branch connector 5A according to the first embodiment includes: the first housing 10 having the wiring route portion 11 in which the two first cables W1 constituting a twisted pair cable is wired in a twisted shape with an increased distance between the two first cables W1; and the second housing 20 to which the pair of pressure contact terminals 50 respectively connected with the two second cables W2 constituting a twisted pair cable is fixed, in which the pair of pressure contact terminals 50 is respectively connected with the two first cables W1 by pressure contact in a state where the second housing 20 is assembled with the first housing 10.

Accordingly, it is possible to branch a twisted pair cable while maintaining communication quality, since the two first cables W1 are wired with the twisted shape being maintained though the distance between the two first cables is increased.

The wiring route portion 11 has the twist grooves 12 following the twisted shape of the two first cables W1 spaced apart from each other. Accordingly, the twisted shape of the two first cables W1 can be reliably maintained, and it is therefore possible to reliably maintain communication quality.

The wiring route portion 11 has the ribs 13*a*, 13*b* that wedge into spaces between the two first cables W1. Accordingly, it is possible to easily increase the distance between the two first cables W1.

The uniting housing 21 of the second housing 20 includes the projecting wall 24 that enters into the twist grooves 12 in a state where the second housing 20 is assembled with the first housing 10. Accordingly, the first cables W1 can be reliably positioned in the twist grooves 12, and this contributes to maintenance of communication quality. Especially regarding the branch connector 5A according to the first embodiment, the projecting wall 24 has a shape following the shape of the twist grooves 12 (a shape following the twisted shape with an increased distance between the two first cables W1), and it is therefore possible to achieve reliable positioning over the whole area of the twist grooves 12.

The second housing 20 includes: the uniting housing 21 which is assembled with the first housing 10 and has the connector fitting portion 29; and the terminal fixing housing 31 to which the pair of pressure contact terminals 50 is fixed and which is fitted to the connector fitting portion 29.

Accordingly, the branch connector 5A can perform the operation of branching a twisted pair cable by operation similar to male and female connectors connection. The degree of freedom in operation is improved, since the operation of assembling the first housing 10 and the uniting housing 21 with the trunk line w1 (trunk line w1 side operation), and the operation of fitting the terminal fixing housing 31, which is connected with branch line w2, with the uniting housing 21 (operation of connecting the branch line w2 with the trunk line w1) can be performed at separate timing.

The ribs 13*a*, 13*b* of the two first cables W1 are interposed between the two first cables W1 constituting a twisted pair cable at three places, and the pressure contact blades 52 are connected to the two first cables W1 by pressure contact at the positions of the central rib 13*a*. Accordingly, even if tensile force of the two first cables W1 acts on the branch connector 5A, the tensile force of the first cable W1 does not directly act on the pressure contact connection place by the pressure contact blades 52, and therefore the reliability of the pressure contact connection is high.

The ferrite components 42 are mounted respectively on the outer circumference of the end portions of the pair of second cables W2 to which the pair of pressure contact terminals 50 is fixed. Although the end portions of the pair of second cables W2 are fixed to the pair of pressure contact terminals 50 in a state where the twisted shape is unwound, it is possible to prevent lowering of communication quality as much as possible, since electromagnetic noise from the respective second cables W2 is reduced by the ferrite components 42.

The communication network 1 includes: the two first cables W1 constituting a twisted pair cable; the two second cables W2 constituting a twisted pair cable; and the branch connector 5A, which connects the two first cables W1 with the two second cables W2 and has the above-mentioned structure. Accordingly, although the distance between the two first cables W1 is increased in the branch connector 5A, wiring is achieved with the twisted shape being maintained even in the branch connector 5A. As described above, it is possible to obtain a communication network 1 in which a twisted pair cable is branched while maintaining communication quality.

Second Embodiment

FIGS. 10 to 13 illustrate a second embodiment.

A communication network 1 according to the second embodiment has a structure similar to that of the first embodiment (see FIG. 10). In the communication network 1, a branch connector (branch connection structure) 5B according to the second embodiment is used for branching a twisted pair cable.

The branch connector 5B according to the second embodiment is different from the branch connector 5A according to the first embodiment in that a second housing 20 is formed of a single housing.

In other words, in the second housing 20, a uniting housing 21 to be assembled with a first housing 10 and a terminal fixing housing 31 to which a pair of pressure contact terminals 50 is fixed are formed integrally with each other. Since the second housing 20 is formed integrally in such a manner, the second locking claws 39*a* and the elastic locking frames 30 configured to lock the uniting housing 21 and the terminal fixing housing 31 to each other in the first embodiment are not provided.

Since the other structure of the second embodiment is similar to that of the first embodiment, the same constituent parts are denoted by the same reference numerals, and the description thereof is omitted.

Next, the assembling procedures of the branch connector 5B according to the second embodiment will be described.

Two first cables W1 constituting a twisted pair cable are inserted into the twist grooves 12 of the first housing 10 as described in the first embodiment.

Next, in the manner described in the first embodiment, the operation of connecting the pressure contact terminals 50 respectively with the two second cables W2 constituting a twisted pair cable, and the operation of fixing the pressure contact terminals 50 to the terminal fixing housing 31 of the second housing 20 are performed.

Next, in the manner described in the first embodiment, the uniting housing 21 of the second housing 20 is united with the first housing 10. As a result, the projecting wall 24 of the uniting housing 21 enters into the twist grooves 12 of the first housing 10, and the first cables W1 are positioned in the twist grooves 12.

In such uniting process, the pressure contact blades 52 of the pair of pressure contact terminals 50 enter into the twist grooves 12 while being guided by the pressure contact blade guide grooves 14. In the fitting complete state, the respective pressure contact blades 52 of the pair of pressure contact terminals 50 are connected with the respective first cables W1 by pressure contact.

With the branch connector 5B according to the second embodiment, it is also possible to branch a twisted pair cable while maintaining communication quality for a reason similar to that of the first embodiment, since the two first cables W1 are wired with the twisted shape being maintained though the distance between the two first cables W1 is increased in the branch connector 5B.

In the second housing 20, the uniting housing 21 to be assembled with the first housing 10 and the terminal fixing housing 31 to which the pair of pressure contact terminals 50 is fixed are formed integrally with each other. Therefore, with the branch connector 5B according to the second embodiment, it is unnecessary to perform the operation of fitting the uniting housing 21 and the terminal fixing housing 31 to each other, and therefore the operability in assembling of the branch connector 5B is better than that of the first embodiment. Moreover, the branch connector 5B according to the second embodiment is reduced in the number of components, and reduced in weight or the like compared to the first embodiment.

The communication network 1 according to the second embodiment includes the branch connector 5B having the above-mentioned structure configured to connect the two first cables W1 and the two second cables W2 with each other. Accordingly, with the second embodiment, it is also possible to obtain the communication network 1 in which a twisted pair cable is branched while maintaining communication quality for a reason similar to that of the first embodiment.

First Modification of First Embodiment

Figure 14:
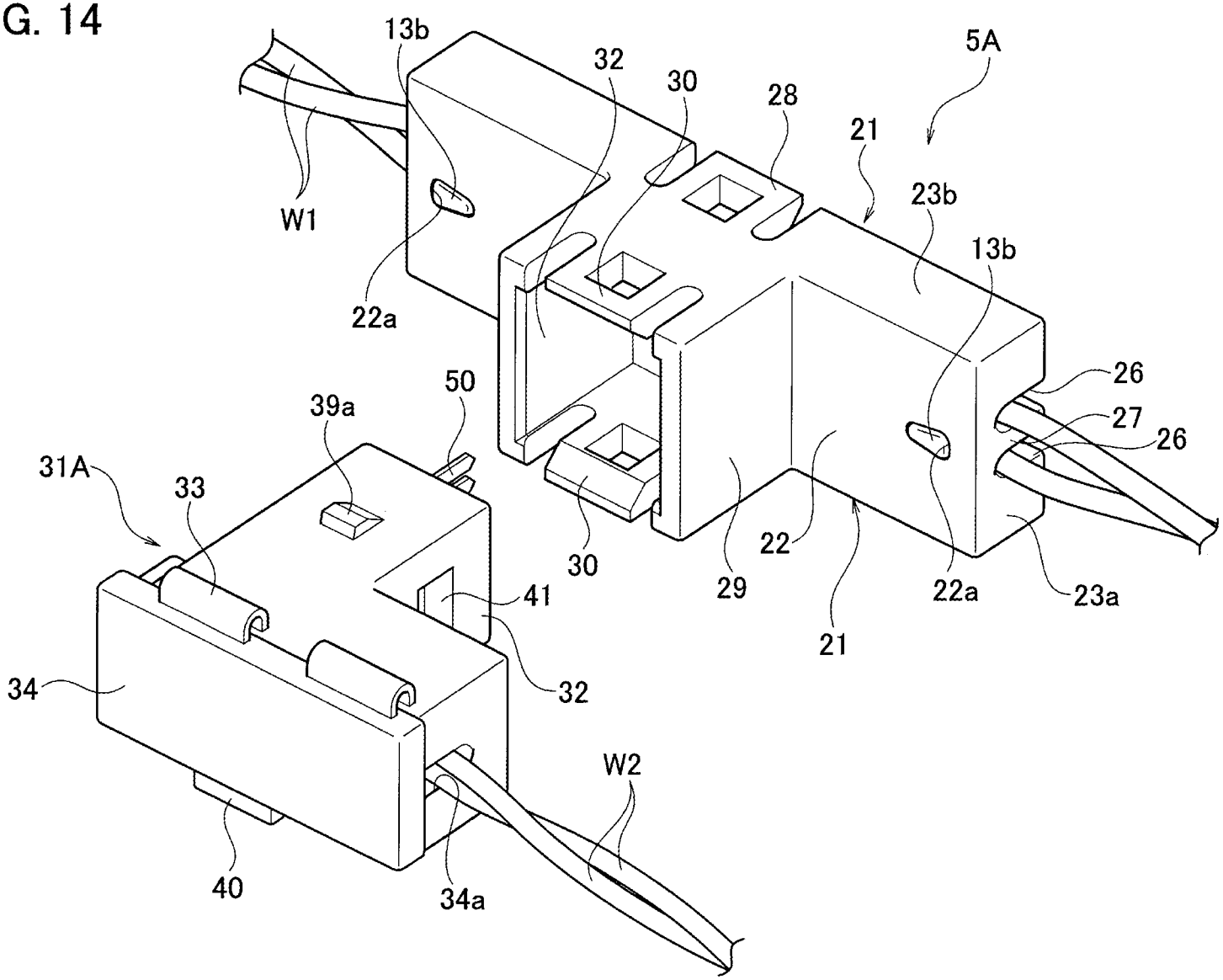
FIG. 14 is a perspective view of a branch connector according to a first modification of the first embodiment.

FIG. 14 illustrates a first modification of the first embodiment.

A branch connector 5A according to the first modification is different from the first embodiment in the structure of a terminal fixing housing 31A. That is, the terminal fixing housing 31A of the first modification is configured to draw out the second cables W2 in a direction orthogonal to the fitting direction of the connector fitting portion 29. In the first modification, the second cables W2 can be drawn out smoothly in a desired wiring direction when the wiring route of the second cables W2 is parallel to the first cables W1.

The other structure of the first modification is the same as that of the first embodiment. The same constituent parts as those of the first embodiment are denoted by the same reference numerals, and the description thereof is omitted.

The first modification can also be applied to the branch connector 5B according to the second embodiment.

Second Modification of First Embodiment

Figure 15:
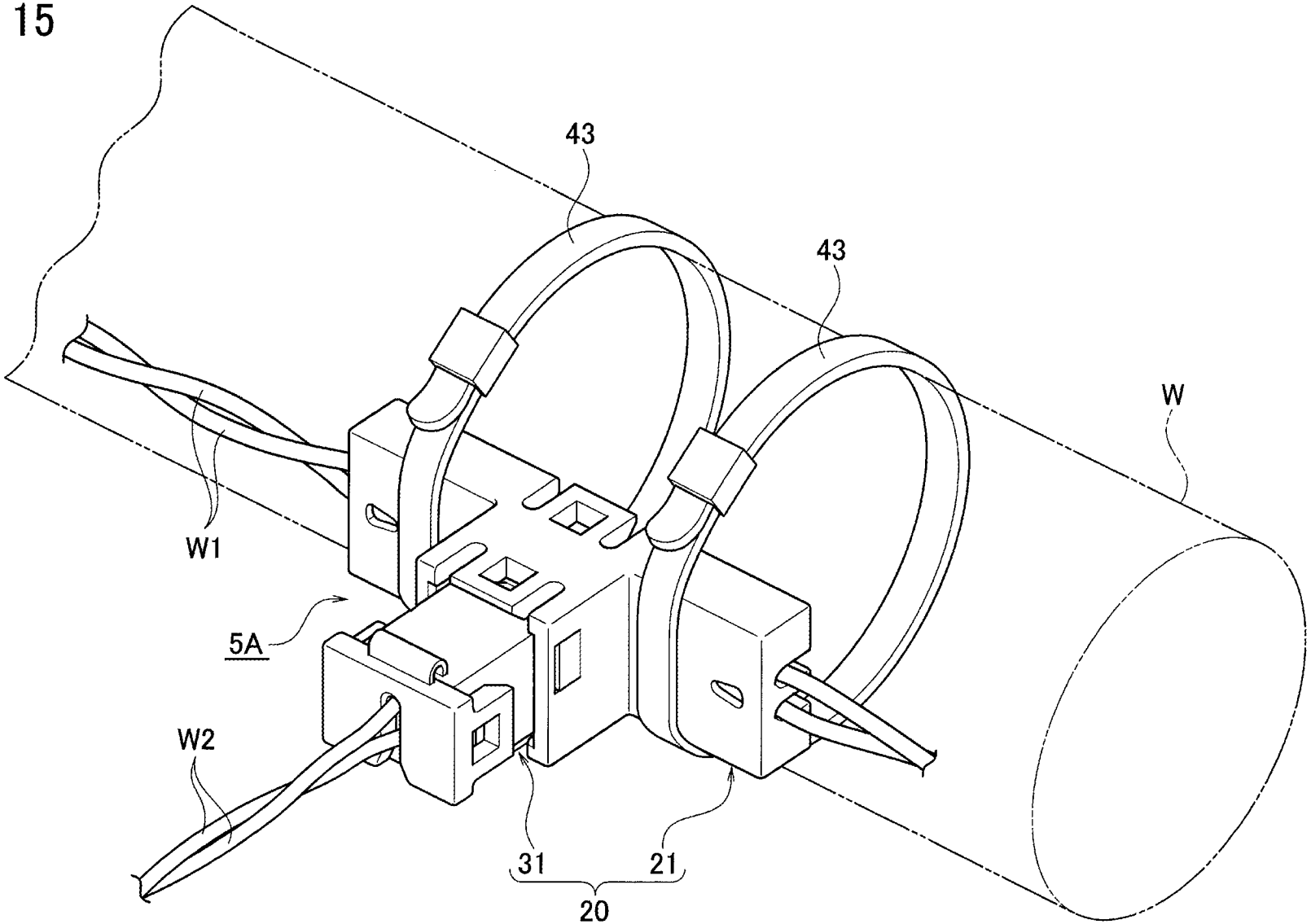
FIG. 15 is a schematic perspective view of a branch connector according to a second modification of the first embodiment.

FIG. 15 illustrates a second modification of the first embodiment. A branch connector 5A according to the second modification is different from the first embodiment in that fastening bands 43 are provided at the uniting housing 21. The branch connector 5A can be fixed to the cable (trunk line) W of a wire harness by the fastening bands 43. The second modification can also be applied to fixing of the branch connector 5A to members other than a cable (trunk line) W.

The other structure of the second modification is the same as that of the first embodiment. The same constituent parts as those of the first embodiment are denoted by the same reference numerals, and the description thereof is omitted.

The second modification can also be applied to the branch connector 5B according to the second embodiment.

Third Modification of First Embodiment

Figure 16:
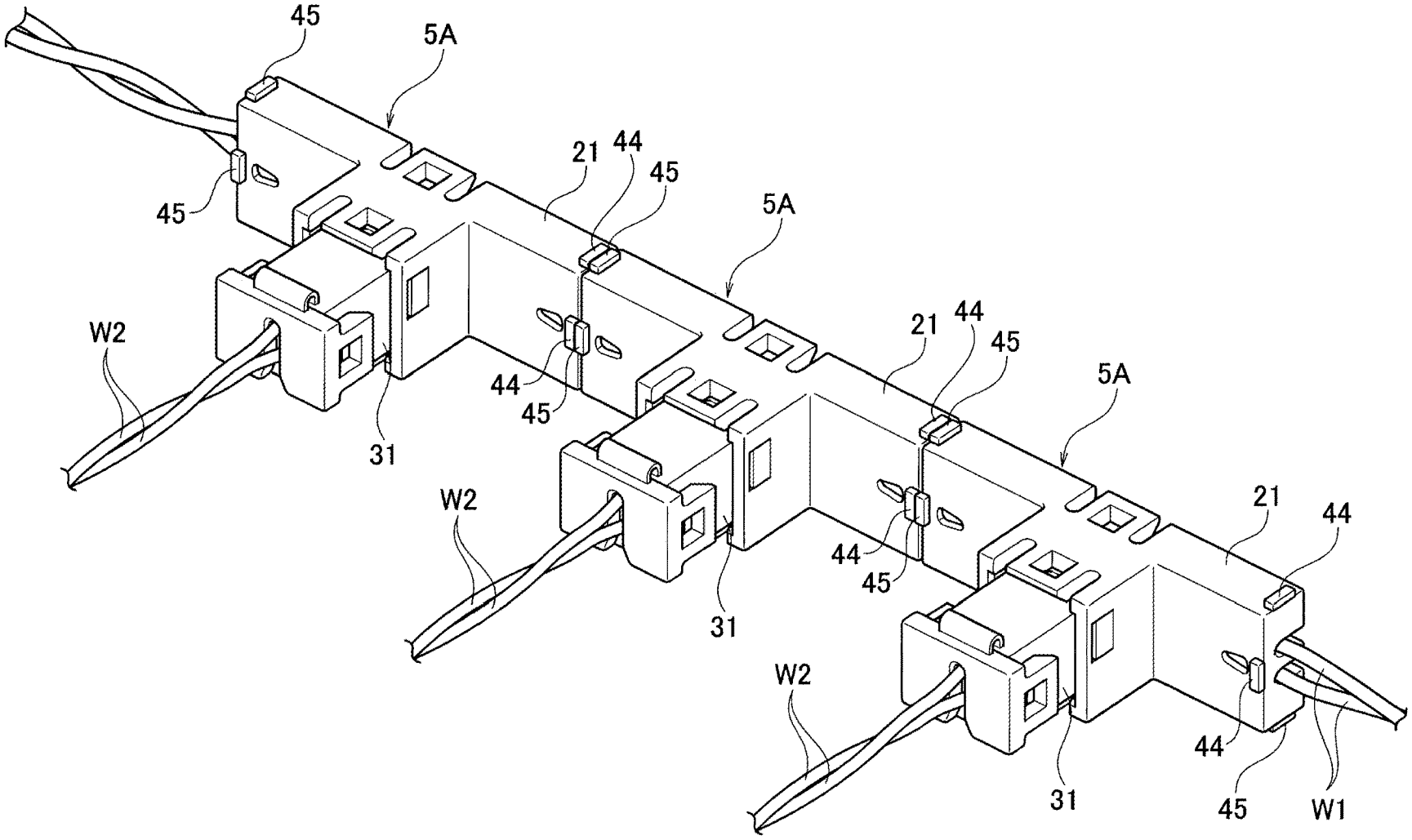
FIG. 16 is a schematic perspective view of a branch connector according to a third modification of the first embodiment.
Figure 17:
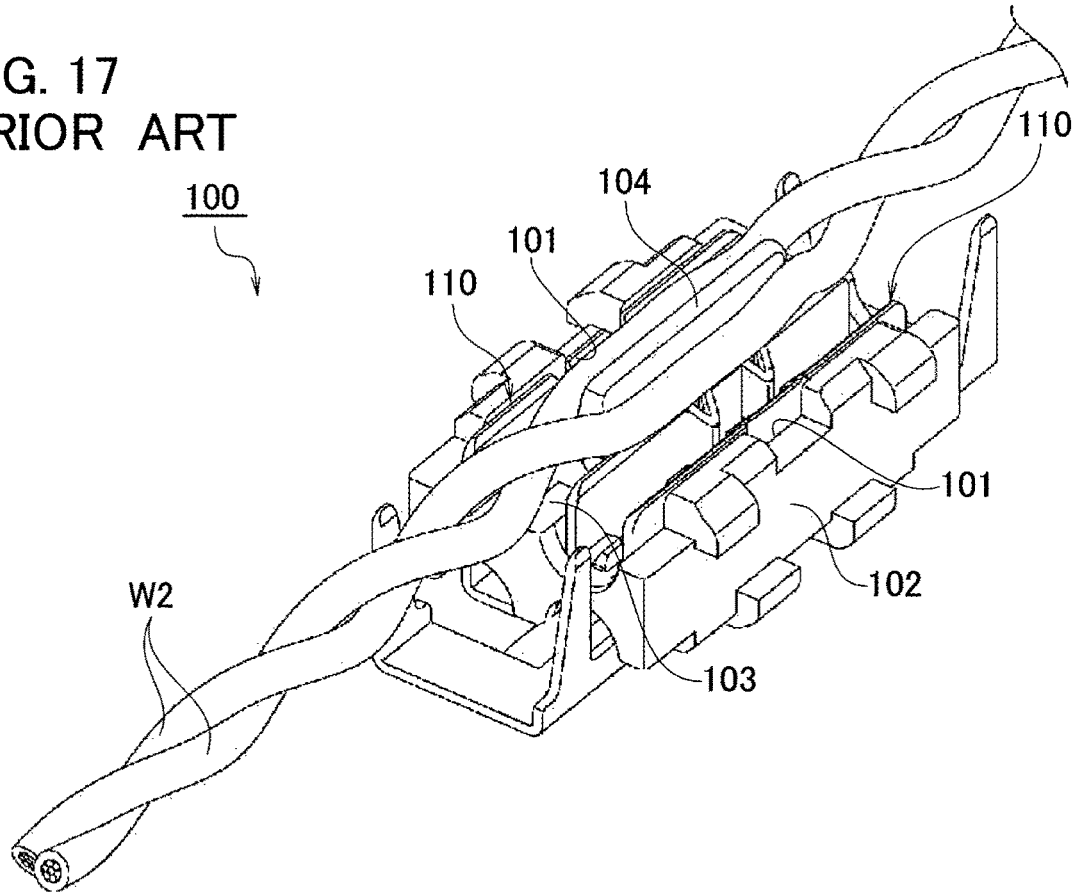
FIG. 17 PRIOR ART
FIG. 17 is a perspective view of a conventional branch connector.
Figure 18:
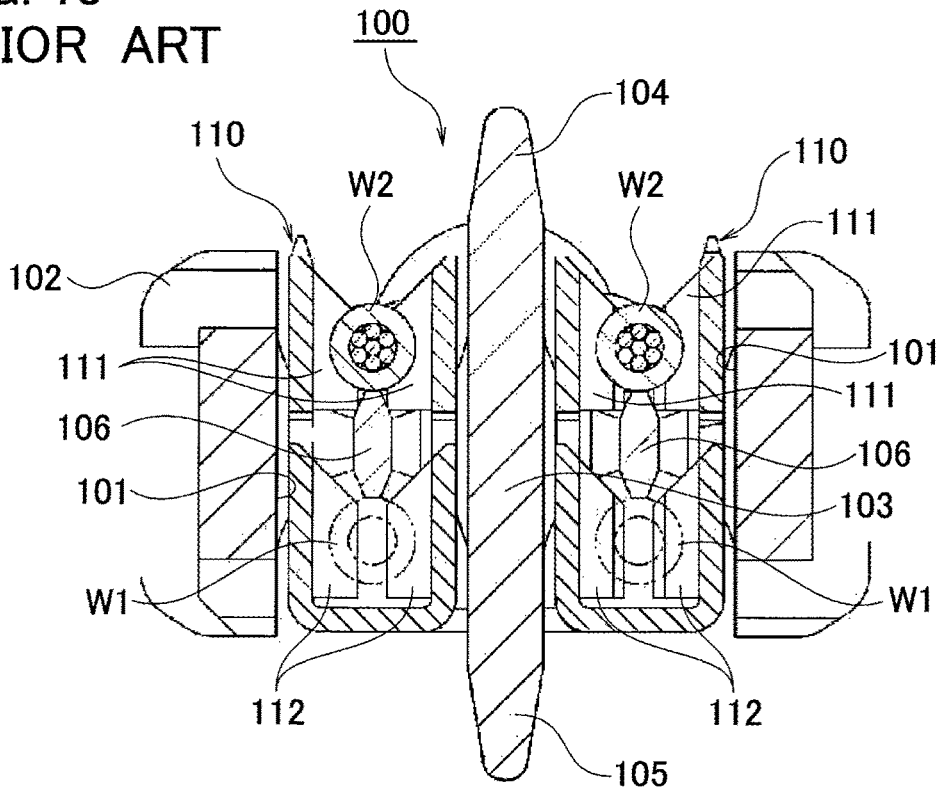
FIG. 18 PRIOR ART
FIG. 18 is a sectional view of the conventional branch connector.

FIG. 16 illustrates a third modification of the first embodiment.

A branch connector 5A according to the third modification is different from the first embodiment in that coupling portions 44, 45 are provided at both end portions of the uniting housing 21. In the third modification, a plurality of branch connectors 5A can be coupled. This is convenient in the case of branching a plurality of sets of second cables W2 at the same branch point of a trunk line w1. Moreover, since the plurality of branch connectors 5A can be integrated, the plurality of branch connectors 5A can be handled as a single component, and excellent component handleability can be obtained. For example, there is no need to perform operation of fixing each individual branch connector 5A to a vehicle body.

(Other Modifications)

Although the second housing 20 has one pair of pressure contact terminals 50, that is, one set of pressure contact terminals 50 in each of the above embodiments, the second housing 20 may have a plurality of sets of pressure contact terminals 50. In such a case, a plurality of sets of pressure contact terminals 50 may be connected with one set of (two constituting a twisted pair cable) second cables W2, or a plurality of sets of pressure contact terminals 50 may be connected respectively with a plurality of sets of second cables W2.

Although the ribs 13*a*, 13*b* are interposed at three places of the two first cables W1 constituting a twisted pair cable in each of the above embodiments, the number of ribs may be one, two, four or more.

Although the wiring route portion 11 is formed of the twist grooves 12 and the ribs 13*a*, 13*b* in each of the above embodiments, any structure may be employed as long as the two first cables W1 can be wired in a twisted shape with an increased distance between the two first cables W1. For example, the wiring route portion 11 may be configured with only the twist grooves 12, or may be configured with only the rib 13*a*.

Although the wiring route portion 11 has the twist grooves 12 in each of the above embodiments, a pair of side walls following a twisted shape with an increased distance between the two first cables W1 may be erected and formed at the first housing 10. The pair of side walls may be intermittent side walls instead of continuous side walls.

Although the projecting wall 24 provided at the uniting housing 21 of the second housing 20 has a shape following the shape of the twist grooves 12 (a shape following the twisted shape with an increased distance between the two first cables W1) in each of the above embodiments, a plurality of projecting walls intermittently inserted into the twist grooves 12 may be employed.

What is claimed is:

1. A branch connector, comprising:

a first housing having a wiring route portion in which two first cables constituting a twisted pair cable are wired in a twisted shape to be spaced apart from each other; and a second housing to which a pair of pressure contact terminals connected respectively with two second cables constituting a twisted pair cable is fixed, the pair of pressure contact terminals being connected respectively with the two first cables by pressure contact in a state where the second housing is assembled with the first housing, wherein the first housing maintains the twisted shape of the two first cables constituting the twisted pair cable within the wiring route portion such that a twist pitch of the two first cables constituting the twisted pair cable in the wiring route portion is substantially the same as a twist pitch of the two first cables constituting the twisted pair cable outside of the wiring route portion.

2. The branch connector according to claim 1, wherein the wiring route portion is provided with twist grooves following the twisted shape of the two first cables spaced apart from each other.

3. The branch connector according to claim 2, wherein the second housing comprises a projecting wall that enters into the twist grooves in a state where the second housing is assembled with the first housing.

4. The branch connector according to claim 1, wherein the wiring route portion comprises a rib configured to wedge into a space between the two first cables.

5. The branch connector according to claim 1, wherein the second housing comprises:

a uniting housing, which is assembled with the first housing and has a connector fitting portion; and a terminal fixing housing to which the pair of pressure contact terminals is fixed and which is fitted to the connector fitting portion.

6. The branch connector according to claim 5, wherein the uniting housing and the terminal fixing housing are formed integrally.

7. The branch connector according to claim 1, further comprising a ferrite component mounted on outer circumference of each of end portions of the pair of second cables to which the pair of pressure contact terminals is fixed.

8. The branch connector according to claim 1, wherein the twist pitch of the two first cables constituting the twisted pair cable in the wiring route portion is substantially the same as the twist pitch of the two first cables constituting the twisted pair cable outside of the wiring route portion on both of lateral sides of the wiring route portion.

9. A communication network, comprising:

two first cables constituting a twisted pair cable;

two second cables constituting a twisted pair cable; and a branch connector including a first housing having a wiring route portion in which the two first cables are wired in a twisted shape to be spaced apart from each other, and a second housing to which a pair of pressure contact terminals connected respectively with the two second cables is fixed, the pair of pressure contact terminals being connected respectively with the two first cables by pressure contact in a state where the second housing is assembled with the first housing, wherein the branch connector connects the two first cables and the two second cables with each other, and wherein the first housing maintains the twisted shape of the two first cables constituting the twisted pair cable within the wiring route portion such that a twist pitch of the two first cables constituting the twisted pair cable in the wiring route portion is substantially the same as a twist pitch of the two first cables constituting the twisted pair cable outside of the wiring route portion.

10. The communication network according to claim 9, wherein the wiring route portion is provided with twist grooves following the twisted shape of the two first cables spaced apart from each other.

11. The communication network according to claim 10, wherein the second housing comprises a projecting wall that enters into the twist grooves in a state where the second housing is assembled with the first housing.

12. The communication network according to claim 9, wherein the wiring route portion comprises a rib configured to wedge into a space between the two first cables.

13. The communication network according to claim 9, wherein the second housing comprises:

a uniting housing, which is assembled with the first housing and has a connector fitting portion; and a terminal fixing housing to which the pair of pressure contact terminals is fixed and which is fitted to the connector fitting portion.

14. The communication network according to claim 13, wherein the uniting housing and the terminal fixing housing are formed integrally.

15. The communication network according to claim 9, further comprising a ferrite component mounted on outer circumference of each of end portions of the pair of second cables to which the pair of pressure contact terminals is fixed.

16. The communication network according to claim 9, wherein the twist pitch of the two first cables constituting the twisted pair cable in the wiring route portion is substantially the same as the twist pitch of the two first cables constituting the twisted pair cable outside of the wiring route portion on both of lateral sides of the wiring route portion.

* * * * *